United States Patent [19]

Forster

[11] 4,011,840

[45] Mar. 15, 1977

[54] DRIVE SYSTEM FOR A MOTOR VEHICLE

[75] Inventor: Hans-Joachim M. Forster, Stuttgart, Germany

[73] Assignee: Daimler-Benz Aktiengesellschaft, Germany

[22] Filed: Apr. 28, 1975

[21] Appl. No.: 572,191

[30] Foreign Application Priority Data

Apr. 30, 1974 Germany ..... 2420820

[52] U.S. Cl. ..... 123/3; 123/DIG. 12; 123/1 A

[51] Int. Cl.[2] ..... F02B 43/08

[58] Field of Search ..... 123/DIG. 12, 1 A, 3, 123/119 E

[56] References Cited

UNITED STATES PATENTS

| | | | |
|---|---|---|---|
| 3,608,660 | 9/1971 | Smith | 123/1 A X |
| 3,616,779 | 11/1971 | Newkirk | 123/DIG. 12 |
| 3,635,200 | 1/1972 | Rundell et al. | 123/3 |
| 3,682,142 | 8/1972 | Newkirk | 123/1 A X |
| 3,688,755 | 9/1972 | Grayson et al. | 123/1 A UX |
| 3,732,690 | 5/1973 | Meyer | 123/1 A X |
| 3,818,875 | 6/1974 | Phillips et al. | 123/1 A X |
| 3,890,946 | 6/1975 | Wahl | 123/1 A X |
| 3,897,757 | 8/1975 | Abello | 123/DIG. 12 |

*Primary Examiner*—Charles J. Myhre
*Assistant Examiner*—Ira S. Lazarus
*Attorney, Agent, or Firm*—Craig & Antonelli

[57] ABSTRACT

A drive for a motor vehicle with an internal combustion engine which is fed from a fuel tank with a fossil fuel by way of a fuel line; the fuel tank is thereby also connected with a cracking carburetor from which a line leads to a hydride storage device which, in turn, is connected with the internal combustion engine; the internal combustion engine can be operated with pure hydrogen or with a hydrogen-fuel-gas mixture in high density traffic areas as well as with a large excess of air whereas it can be operated on open highways, after shifting, with a conventional fossil fuel and with an air ratio number of about 1.

26 Claims, 1 Drawing Figure

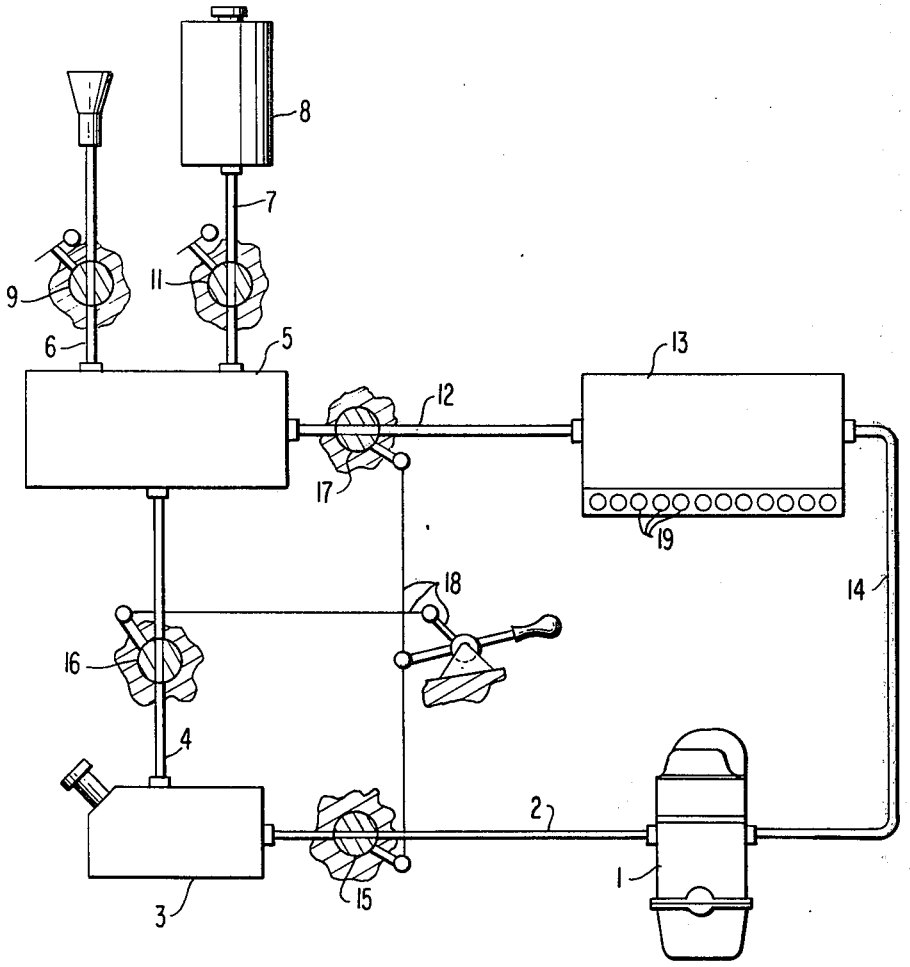
8
7
9
11
6
5
13
12
17
19
18
14
16
4
2
1
3
15

DRIVE SYSTEM FOR A MOTOR VEHICLE

The present invention relates to a drive for a motor vehicle with an internal combustion engine, which is supplied with a fossil fuel from a fuel tank by way of a fuel line.

It is known in principle that an internal combustion engine can be operated with hydrogen or with another mixture enriched with hydrogen. A combustion engine whose combustion gas has a high hydrogen proportion, can be leaned down extremely so that, on the one hand, only disappearingly small CO—, HC— and $NO_x$— concentrations are present in the exhaust gas and simultaneously a better efficiency of the engine can be achieved in the transition to a quality control.

It is also known that increased hydrogen proportions in the combustion gas permit a larger excess of air and therewith a decrease of the harmful substance emission. In relation to carbon monoxide and nitrogen oxides, it is possible to stay below the most strict, heretofore provided limit values. However, the emission values of the hydrocarbons cannot be kept as low as one would like to by such measures.

It is further known that with pure hydrogen operation no carbon monoxides and no hydrocarbons are emitted and that it offers no difficulty to keep extremely low the proportions of the nitrogen oxides. However, it is still open in that connection how the hydrogen can be made ready and available in larger quantities and at different places to a sufficient extent.

It is additionally known that fuel can be gasified in cracking carburetors with or without catalysts. In the gasoline cracking, which is carried out for the most part with catalytic agents, hydrocarbons can be decomposed into its gaseous components, namely $CH_4$, $H_2$ but also into higher hydrocarbons and into CO together with $CO_2$. However, a considerable expenditure has to be undertaken for the complete, economically acceptable gasification.

Finally, it is also known that promising hydrogen tanks can be represented by metal hydrides of suitable compositions. Metal compounds are able to store hydrogen by the formation of metal hydrides and are able to selectively absorb also hydrogen out of gas mixtures. However, for purposes of filling these tanks or hydrogen storage devices, a suitable infra-structure is still required which will certainly not be available for some longer periods of time.

It is the aim of the present invention to provide a self-sufficient drive for a motor vehicle, i.e., independent of "hydrogen tanking places", which is still economical to an acceptable extent and falls below the strictest safety limits to be expected in areas of high traffic density where bumper traffic and/or traffic tie-ups occur, and which additionally permits an economic driving of the motor vehicle in a known manner and with known means, namely with fossil fuels. The fossil fuels thereby should also serve as basic substance for the production of the fuels to be used in high density traffic areas.

The underlying problems are solved according to the present invention in that the fuel tank is additionally connected with a cracking carburetor or any conventional construction, from which a line leads to a hydride storage device which in turn is connected with the internal combustion engine which can be operated with hydrogen or with a hydrogen-fuel-gas mixture as well as with a high excess of air in high-density traffic or jam-up areas and which, after shifting, can be operated with a fossil fuel and a value of $\lambda$ of about 1 on open highways.

Such a drive system is able to get along with the present-day fuel supply but can be converted later on also without difficulty to a supply of fuel with hydrogen. With this drive system, the type of combustion and the combustion mixture may always be so selected as is necessary in order to realize the required emission. In traffic jam or high density traffic areas, one will drive only with hydrogen, in suburbs one will shift to a hydrogen-gasoline-gas mixture operation, and on open highways, one will drive with fossil fuel as under classic operation. During the operation with hydrogen, it is therefore possible to drive with a high excess of air in order to lower the emission of harmful exhaust gas components and simultaneously also the fuel consumption, especially during mixture operation. This is so as one has started heretofore with the concept that the hydrogen necessary for the operation has to be tanked in some distributor network. Since it will probably be still some time until the technology of a hydrogen supply system is developed and the infra-structure necessary therefor has been worked out, the present invention provides with the presently existing infra-structure a drive system which does not require a hydrogen distribution network because in the present invention the necessary hydrogen is produced in the vehicle itself.

According to a further feature of the present invention, one valve each may be arranged in the line connecting the fuel tank with the engine and in the line connecting the cracking carburetor with the hydride storage device which are opened and closed at the same time and in the same sense. The closing of the valve in the line which connects the gasoline tank with the engine may thereby take place only to a certain degree so that this valve still remains open slightly with the closing of the other valve so that in addition to the hydrogen, a small quantity of fossil fuel is also supplied to the engine with a high excess of air. If one drives completely with pure hydrogen, then corresponding constructive changes of the engine are required.

As to the rest, a water tank may also be provided which is connected with the cracking carburetor. Consequently, the carburetor may be operated with the addition of air or water or with the addition of both air and water. If the cracking carburetor is operated only with air, then about 50% nitrogen, and 5% $CO_2$ and about 15% of each of CO, $H_2$ and $CH_4$ will then result. If in contradistinction thereto, the cracking carburetor, in addition to being operated with gasoline, is operated only with water, then no nitrogen results, whereas about 70% of $H_2$ and about 10% each of $CO_2$, CO and $CH_4$ will be produced. With a mixture operation by the addition of air and water, these values change correspondingly to the admixed quantity ratios of air and water.

The hydride storage device may also be provided with a heating system, by means of which the yield or output of the hydrogen can be stimulated during the beginning of the shifting to hydrogen operation. On the other hand, the hydride storage device may be cooled in order to favor the absorption of hydrogen.

The advantage of the present invention resides in that all advantages can be realized with the same which offers a pure hydrogen operation or an operation in which hydrogen is used in part, without being relegated to a hydrogen infra-structure.

Accordingly, it is an object of the present invention to provide a drive for a motor vehicle which avoids by simple means the aforementioned shortcomings and drawbacks encountered in the prior art.

Another object of the present invention resides in an internal combustion engine for a motor vehicle capable of operation with hydrogen as fuel which offers an economically acceptable operation without excessive expenditures.

A further object of the present invention resides in a drive arrangement for a motor vehicle operable by the use of hydrogen which does not require the availability of hydrogen through an established distribution network.

A still further object of the present invention resides in a drive for an internal combustion engine which is completely self-sufficient insofar as the operation of the engine with hydrogen as fuel is concerned.

Another object of the present invention resides in a drive for an internal combustion engine operable with hydrogen which is economically feasible within acceptable expenditures and is capable of meeting all safety limits as regards exhaust contamination which are presently expected.

A further object of the present invention resides in a drive for a motor vehicle which permits operation of the vehicle both with fossil fuels and hydrogen in an economically feasible manner.

Still another object of the present invention resides in a drive for a motor vehicle with the use of hydrogen which is able to get along with the fuel supply system available at present.

A still further object of the present invention resides in a drive arrangement for an internal combustion engine of a motor vehicle in which the emission of harmful exhaust gas components can be lowered and the fuel consumption can be improved.

These and further objects, features and advantages of the present invention will become more apparent from the following description when taken in connection with the accompanying drawing which shows, for purposes of illustration only, one embodiment in accordance with the present invention, and wherein:

The single FIGURE is a schematic view of a drive arrangement for an internal combustion engine of a motor vehicle in accordance with the present invention.

Referring now to the single FIGURE of the drawing, a combustion engine 1 which may be a Diesel engine or an Otto engine is schematically illustrated therein together with the associated auxiliary means according to the present invention.

The combustion engine 1 is connected by way of a fuel line 2 with the fuel tank 3 which may contain either gasoline or Diesel fuel. Furthermore, the fuel tank 3 is connected by way of a line 4 with a conventional cracking carburetor 5 of known construction, in which the hydrocarbons of the fuel are decomposed into gases components of $CH_4$, $H_2$ as well as into higher hydrocarbons and CO.

Air can be fed to the cracking carburetor 5 by way of the line 6 and water may be fed thereto out of a water tank 8 by way of the line 7. The lines 6 and 7 are provided with valves 9 and 11 which may be selectively opened or closed depending on the requirement.

The cracking carburetor 5 is connected by way of the line 12 with a hydride storage device 13 of conventional type. This hydride storage device 13 is able to conduct to the engine 1 by way of the line 14, hydrogen previously stored and/or other gases resulting in the carburetor 5 during the cracking of the fuel.

The lines 2, 4 and 12 are provided with valves 15, 16 and 17, respectively, whose operating levers are connected with each other by a linkage 18 so that they can be opened and closed simultaneously. The valve 15 may be so constructed that it is still slightly opened when the valves 16 and 17 are already closed.

The engine 1 can now be operated in the usual manner with gasoline. For that purpose, the valves 15, 16 and 17 are opened. Fuel is thereby conducted from the fuel tank 3 not only by way of the line 2 to the engine 1 but also by way of the line 4 to the cracking carburetor 5. The fuel is cracked in the cracking carburetor 5 into gaseous components which are conducted by way of the line 12 to the hydride storage device 13. The latter absorbs the hydrogen which is stored in the alloy disposed on the inside thereof. The remaining gas which has also been produced in the cracking carburetor 5 flows through the hydride storage device 13 and will also be still conducted to the engine 1 by way of the line 14 so that these gases can also be utilized in the combustion engine 1. The composition of the gases cracked in the cracking carburetor 5 depends on whether the cracking carburetor is operated without water or with water out of the water tank 8. With a larger supply of water, the nitrogen content can be reduced to zero.

This manner of driving will preferably be selected on open highways whereby one will drive with an air ratio number of about $\lambda = 1$. The hydride storage device 13 is thereby being charged. If one now approaches suburban areas or high-density traffic areas, then one will shift by means of the lever linkage 18, either to a partial removal of $H_2$ out of the hydride storage device 13 or by completely closing the valves 15, 16 and 17, to a driving operation with pure hydrogen. One will thereby operate with an air ratio number which lies considerably above 1 ($\lambda$ may reach a value up to 2) whereby exhaust gases free of harmful substances can be achieved.

In order to stimulate the discharge of the hydride storage device 13, the latter may be equipped with a heater 19 of any conventional construction which may also be constructed for the reverse case as cooling installation, utilizing known principles for this purpose.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

What is claimed is:

1. A drive for a motor vehicle with an internal combustion engine which is supplied with fossil fuels from a fuel tank by way of a fuel line, characterized in that the fuel tank is operatively connected also with a cracking carburetor means from which a line leads to a hydride storage means which, in turn, is operatively connected with the combustion engine, the combustion engine being operable in areas of high traffic density with at least a hydrogen-fuel-gas mixture as well as with a high excess of air whereas, upon shifting over, it can be operated with fossil fuel and with an air ratio number of about 1 on open highways.

2. A drive according to claim 1, characterized in that the combustion engine is selectively operable with hydrogen in areas of high traffic density.

3. A drive according to claim 1, characterized in that one valve means each is arranged in the line connecting the fuel tank with the engine and in the line connecting the cracking carburetor means with the hydride storage means, which are open and closed in the same direction and substantially at the same time.

4. A drive according to claim 3, characterized in that a water tank is provided which is operatively connected with the cracking carburetor means.

5. A drive arrangement according to claim 4, characterized in that the hydride storage means is provided with a heater means.

6. A drive according to claim 5, characterized in that the hydride storage means is provided with a cooling means.

7. A drive according to claim 6, characterized in that the heater and cooling means are formed by a reversible heating and cooling system.

8. A drive according to claim 7, characterized in that the combustion engine is selectively operable with hydrogen in areas of high traffic density.

9. A drive according to claim 1, characterized in that a water tank is provided which is operatively connected with the cracking carburetor means.

10. A drive arrangement according to claim 1, characterized in that the hydride storage means is provided with a heater means.

11. A drive according to claim 1, characterized in that the hydride storage means is provided with a cooling means.

12. A drive arrangement according to claim 11, characterized in that the hydride storage means is provided with a heater means.

13. A drive arrangement for motor vehicles, the arrangement comprising:

an internal combustion engine operable on hydrogen or fossil fuel, a fossil fuel tank means for accommodating a supply of fossil fuel, a fossil fuel line means for supplying fossil from said fossil fuel tank means to said internal combustion engine, a cracking carburetor means for decomposing hydrocarbons of the fossil fuel into gaseous components, means for supplying air to said cracking carburetor means, means for communicating said fossil fuel tank means with said cracking carburetor means, a hydride storage means for storing a supply of hydrogen, means for communicating said cracking carburetor means with said hydride storage means, means for communicating said hydride storage means with said internal combustion engine, and means for selectively controlling said fuel line means and each of said communicating means such that the internal combustion engine is selectively operable on hydrogen alone, a hydrogen-fossil fuel mixture, or fossil fuel alone.

14. An arrangement according to claim 13, further comprising a water tank means for accommodating a supply of water, and means for communicating said water tank means with said cracking carburetor means.

15. An arrangement according to claim 14, wherein the internal combustion engine when operated on fossil fuel alone operates with an air ratio number of about 1.

16. An arrangement according to claim 14, wherein means are provided for controlling the supply of air to said cracking carburetor means such that the internal combustion engine is operated with a high excess of air when operating on hydrogen alone.

17. An arrangement according to claim 14, wherein means are provided for controlling the air supplied to the cracking carburetor means such that the internal combustion engine is operated with a high excess of air when operating on a hydrogen-fossil fuel mixture.

18. An arrangement according to claim 13, wherein the internal combustion engine when operated on fossil fuel alone operates with an air ratio number of about 1.

19. An arrangement according to claim 18, further comprising heater means for selectively heating the hydride storage means.

20. An arrangement according to claim 19, further comprising cooling means for selectively cooling the hydride storage means.

21. An arrangement according to claim 13, wherein means are provided for controlling the supply of air to said cracking carburetor means such that the internal combustion engine is operated with a high excess of air when operating on hydrogen alone.

22. An arrangement according to claim 21, further comprising heater means for selectively heating the hydride storage means.

23. An arrangement according to claim 22, further comprising cooling means for selectively cooling the hydride storage means.

24. An arrangement according to claim 13, wherein means are provided for controlling the air supplied to the cracking carburetor means such that the internal combustion engine is operated with a high excess of air when operating on a hydrogen-fossil fuel mixture.

25. An arrangement according to claim 24, further comprising heater means for selectively heating the hydride storage means.

26. An arrangement according to claim 25, further comprising cooling means for selectively cooling the hydride storage means.

* * * * *